US009340942B2

(12) United States Patent
Luppi

(10) Patent No.: US 9,340,942 B2
(45) Date of Patent: May 17, 2016

(54) METHOD FOR INSTALLING A DEVICE FOR RECOVERING HYDROCARBONS

(75) Inventor: Ange Luppi, Nîmes (FR)

(73) Assignee: TECHNIP FRANCE (FR)

( * ) Notice: Subject to any disclaimer, the term of this patent is extended or adjusted under 35 U.S.C. 154(b) by 236 days.

(21) Appl. No.: 13/993,487

(22) PCT Filed: Dec. 12, 2011

(86) PCT No.: PCT/FR2011/052947

§ 371 (c)(1),
(2), (4) Date: Jun. 27, 2013

(87) PCT Pub. No.: WO2012/080640

PCT Pub. Date: Jun. 21, 2012

(65) Prior Publication Data

US 2013/0263426 A1 Oct. 10, 2013

(30) Foreign Application Priority Data

Dec. 14, 2010 (FR) ..... 10 04858

(51) Int. Cl.

| | |
|---|---|
| ***E02B 15/04*** | (2006.01) |
| ***E21B 43/013*** | (2006.01) |
| ***E21B 43/01*** | (2006.01) |
| *E02B 15/00* | (2006.01) |

(52) U.S. Cl.

CPC ..... *E02B 15/04* (2013.01); *E21B 43/0122* (2013.01); *E21B 43/0135* (2013.01); *E02B 2015/005* (2013.01); *Y10T 29/49826* (2015.01)

(58) Field of Classification Search

CPC ..... E02B 15/04; E02B 2015/005; E21B 43/0135; E21B 43/0122; Y10T 29/49826

See application file for complete search history.

(56) References Cited

FOREIGN PATENT DOCUMENTS

| | | | |
|---|---|---|---|
| FR | 2 804 935 | A1 | 8/2001 |
| FR | 2 860 810 | A1 | 4/2005 |
| FR | 2 868 446 | A1 | 10/2005 |
| WO | WO 2005/038145 | A2 | 4/2005 |

OTHER PUBLICATIONS

Machine translation of Biaggi (WO2005/038145).*
Machine translation of Laurent (FR2804935).*
International Search Report and Written Opinion dated Apr. 4, 2012 issued in corresponding International patent application No. PCT/FR2011/052947.

* cited by examiner

*Primary Examiner* — Ryan J Walters
(74) *Attorney, Agent, or Firm* — Ostrolenk Faber LLP

(57) ABSTRACT

A method for installing an assembly (10) for recovering hydrocarbons escaping from an underwater facility (21), including a first bottom assembly (25) including a rigid canopy having a large surface area, and a second top assembly (26) for raising fluids up to a surface facility (13). The steps of towing the fluid-raising top assembly are carried out concurrently during the installation of the fluid-raising top assembly (26).

7 Claims, 6 Drawing Sheets

METHOD FOR INSTALLING A DEVICE FOR RECOVERING HYDROCARBONS

CROSS-REFERENCE TO RELATED APPLICATIONS

The present application is a 35 U.S.C. §§371 national phase conversion of PCT/FR2011/052947, filed Dec. 12, 2011, which claims priority of French Application No. 10/04858, filed Dec. 14, 2010, the contents of which are incorporated by reference herein. The PCT International Application was published in the French language.

BACKGROUND OF THE INVENTION

The invention relates to a method for offshore installation of a system for recovering hydrocarbons escaping from an underwater installation.

With the increasing number of offshore oil wells, there is an increasing risk of ecological accidents associated with hydrocarbons leaking from an underwater installation such as a wellhead or pipe, for example. The environmental consequences for the ecosystem can be irreversible and it is therefore necessary to intervene as quickly as possible to confine and recover the fluids escaping from the underwater installation in order to limit the environmental consequences linked to the outflow of these hydrocarbons into the marine environment.

To this end, it is known to deploy vertically above the damaged underwater installation bells having the shape of an inverted funnel to channel hydrocarbons escaping from the installation and recover them on a ship by means of a recovery pipe connecting the recovery bell and the hydrocarbon recovery ship.

Application WO2005/038145 in the name of the applicant discloses a recovery device comprising a rigid canopy of very large area intended to be deployed vertically over the underwater installation from which hydrocarbons are escaping. The area of the roof of the canopy is of the order of 100 to 10 000 $m^2$. The canopy consists of two dihedral surfaces and is mounted on telescopic anchoring legs for stabilizing the position of the canopy over the underwater installation. It is connected to a flexible hydrocarbon raising pipe that is connected at the bottom to the canopy and extends up to the hydrocarbon recovery and storage ship. Moreover, a collecting chamber is disposed at the apex of the canopy, the flexible pipe being connected directly to the collecting chamber. There are carried out in the collecting chamber all operations beneficial to facilitating raising of the hydrocarbons, which may be very viscous and therefore difficult to raise to the surface via the pipe. These operations may consist in fluidizing the hydrocarbons by heating with electrical elements or by circulating hot water. They may also consist in diluting the hydrocarbons by adding dilutants or in mechanical stirring of the hydrocarbons in the collecting chamber. This recovery system is then towed to site and lowered in vertical alignment with the underwater installation, the buoyancy of the canopy being monitored and adjusted during its descent. The legs of the canopy are then deployed to stabilize the canopy on the seabed and vertically above the underwater installation.

A flexible pipe is then deployed from a pipelaying ship at the destination site. Unmanned submersibles are then used to connect the pipe to the collecting chamber and then to the surface installation.

The complete installation of such a recovery system may take months (two to three months) because it requires steps that are carried out in sequence and the sequential mobilization of a number of ships at the destination site.

These installation methods are therefore unsatisfactory because it is necessary to confine the leaking hydrocarbons as soon as possible to limit the impact on the environment.

SUMMARY OF THE INVENTION

Accordingly, the present invention proposes a method of installing a recovery system including an assembly for raising hydrocarbons to a surface installation that is faster to install at the destination site in a very short time, of a few days.

To this end the method of the invention includes the following steps:

(1) bringing to the destination site a lower or hydrocarbon raising assembly (25) including a rigid canopy (27) having the shape of an inverted funnel and including ballasting compartments (29), (2) deploying the lower assembly toward the seabed (11) vertically above the underwater installation (21), (3) assembling at sea an upper or fluid raising assembly (26) adapted to raise the fluid between the seabed and the surface installation (13), said upper assembly (26) including:

- a first flexible pipe (30) adapted to extend substantially vertically between the seabed (11) and the surface (12),
- a collecting chamber (32) connected to the upstream end (34) of the first flexible pipe (30),
- a buoy (40) connected to the downstream end (35) of the first flexible pipe (30) and adapted to be immersed below the surface of the water (12) to maintain the first flexible pipe (30) substantially in its vertical position,
- a second flexible pipe (33) extending in the form of a catenary and connected to the downstream end of the first flexible pipe (30) and to the surface installation (13), (4) towing the upper assembly (26) to the destination site, (5) connecting the collecting chamber (32) to the lower assembly (25), (6) tensioning the first flexible pipe (30), (7) connecting the downstream end (37) of the second flexible pipe (33) to the surface installation (13).

The method in accordance with the invention is also characterized in that steps 3 and 4 of assembling the upper assembly (26) at sea and towing it to site are effected simultaneously with step 1 and/or step 2.

Thus the upper or fluid raising assembly is assembled and towed to the surface installation in what is otherwise dead time.

In accordance with another feature of the invention, the installation method is characterized in that assembling the upper assembly (26) includes the following steps:

a. bringing a buoy (40) to the body of water, b. paying out in catenary form the first flexible pipe (30) from a pipelaying ship (52) and connecting the downstream end (35) of the first flexible pipe (30) to the buoy (40) while the upstream end (34) is retained by the ship (52), c. paying out the second flexible pipe (33) and connecting its upstream end (38) to the buoy (40)

d. connecting the collecting chamber (32) to the upstream end (34) of the first flexible pipe.

According to other features of the invention, the method in accordance with the invention is characterized in that, at the destination site, the upstream end (34) of the first flexible pipe (30) provided with the collecting chamber (32) is deployed toward the seabed by paying out a disposable line (72) and is then connected to the canopy (27) of the lower assembly (25).

Other features and advantages of the invention will emerge from the description of one embodiment of the invention given hereinafter illustrated by the following figures:

DESCRIPTION OF AN EMBODIMENT

Figure 1:
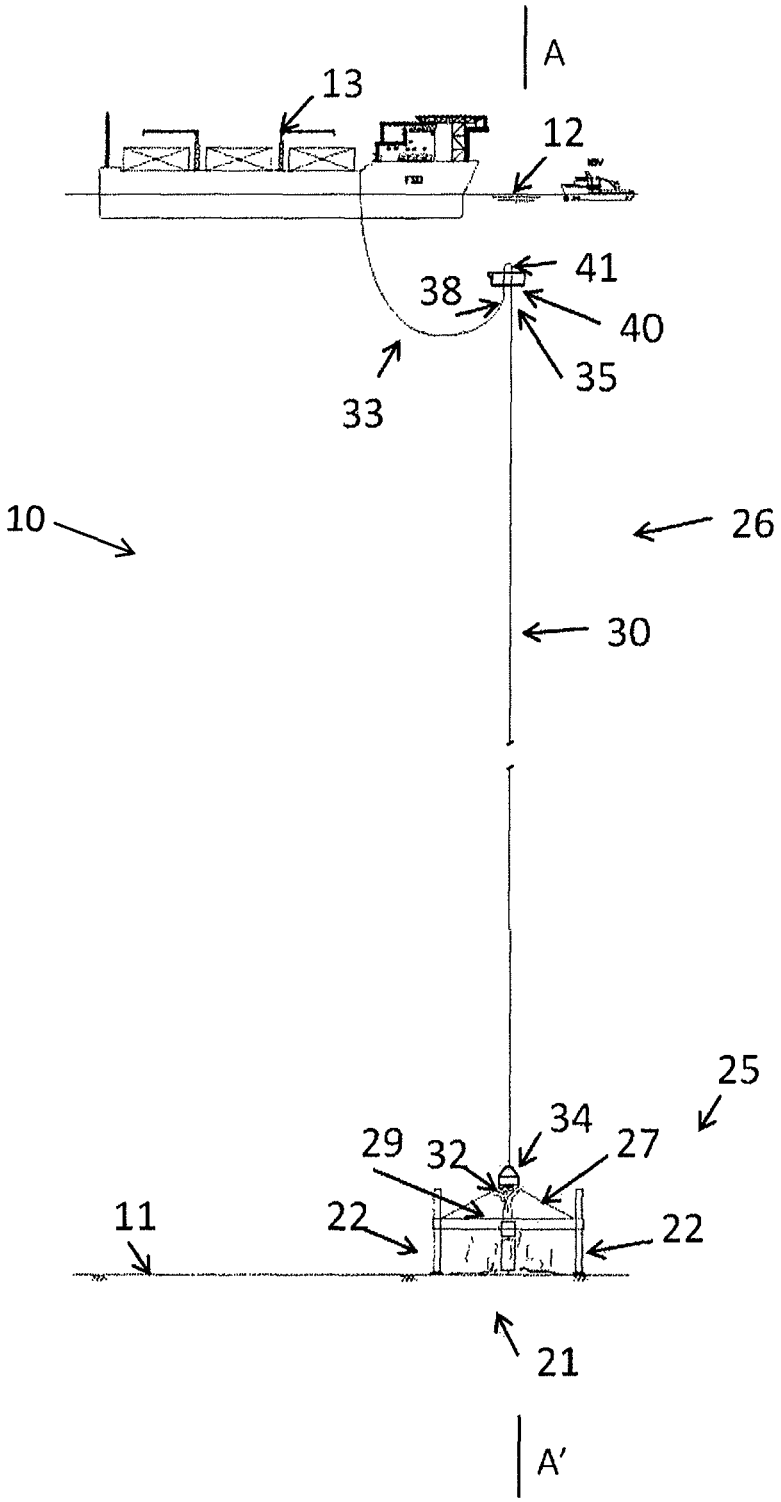
FIG. 1 is a general view of a hydrocarbon recovery device in accordance with the invention.

FIG. 1 shows a general view of a hydrocarbon recovery system assembly (10) installed vertically above an underwater installation (21) from which hydrocarbons to be recovered are escaping.

In the remainder of the text, the terms "upstream" and "downstream" are to be understood as relative to the direction of flow of the fluids when the fluid recovery system is operational.

The underwater installation (21) may for example be an underwater oil well, an underwater pipe that has been damaged or a ship for storing or transporting hydrocarbons that has sunk.

The recovery system comprises a first or lower assembly (25) comprising a rigid canopy (27) of large area. This canopy is the shape of an inverted funnel and includes compartments (29) for adjusting the buoyancy of the canopy during its installation over the underwater installation (21). It further includes legs that can be deployed toward the seabed in the direction A-A' to anchor the lower assembly (25) to the seabed (11).

This rigid canopy is protected by international patent application WO2005/038145 in the name of the applicant incorporated herein by reference.

The function of this lower or recovery assembly is to channel hydrocarbons escaping from the underwater structure (21) toward a flexible pipe (30) in order to recover them in a storage ship (13) such as a tanker, for example.

Accordingly, the canopy advantageously takes the form of two dihedral surfaces forming at their apex a trough leading to the upper part of the canopy to which is connected an upper or hydrocarbon raising assembly (26).

The upper or hydrocarbon raising assembly (26) of the recovery system includes a first flexible pipe (30) extending substantially vertically along the axis A-A'. The first flexible pipe (30) is connected at its upstream end (34) to a collecting chamber (32) at the apex of the canopy (27) of the lower assembly (25) and at its downstream end (35) to a buoy (40) immersed under the surface of the water that exerts an upward traction force in the direction A-N on the first flexible pipe to maintain it in a substantially vertical position.

A shorter second flexible pipe (33) connects the downstream end (35) of the first flexible pipe (30) to the surface installation (13). It preferably extends in the form of a catenary between the buoy (40) and the surface installation (13) in order to accommodate movements of the surface installation (13). Here the fluidic connection (41) between the upstream end (38) of the second flexible pipe (33) and the downstream end (35) of the first flexible pipe (30) is made above the buoy (40) by means of a U-shaped rigid pipe connector (41). Flanges or other ad hoc elements connect the ends of the rigid connector (41) to the ends of the flexible pipes (30, 33).

The collecting chamber (32) connects the volume under the canopy (27) and the interior of the first flexible pipe (30). It collects the hydrocarbons under the canopy before they are raised to the ship (13) via the flexible pipes (30, 33, 41).

This chamber preferably includes means for facilitating raising the hydrocarbons in the first flexible pipe (30). These means may be mechanical stirring elements, electrical heating means or heating means that circulate hot water in small serpentine pipes, or means for injecting dilutants. The collecting chamber is described in application WO2005/038145 in the name of the applicant incorporated herein by reference. Thus it will not be described in detail in the present application.

In the context of the invention, the term "hose" or "flexible pipe" refers to a pipe comprising a plurality of layers that may be bounded or unbounded. These pipes are described in the standards API17j and AP RP 17B published by the American Petroleum Institute (API).

The flexible pipe or hose may advantageously consist of a composite "bundle" comprising at least one flexible pipe for conveying fluids and a set of electrical or optical cables for transmitting electrical or optical power and possibly also including small ancillary pipes for feeding/injecting chemical products into the mixture of hydrocarbons.

A method in accordance with the invention for installing the hydrocarbon recovery assembly (10) will now be described with reference to FIGS. 2 to 8.

The lower or recovery assembly (25) including the rigid canopy (27) previously constructed on land in a shipyard is launched in the vicinity of its place of construction. By virtue of its double-wall hull and caisson type design, the rigid canopy is able to float on the surface of the water. The deployable anchor legs (22) are in their upwardly retracted position.

Figure 2:
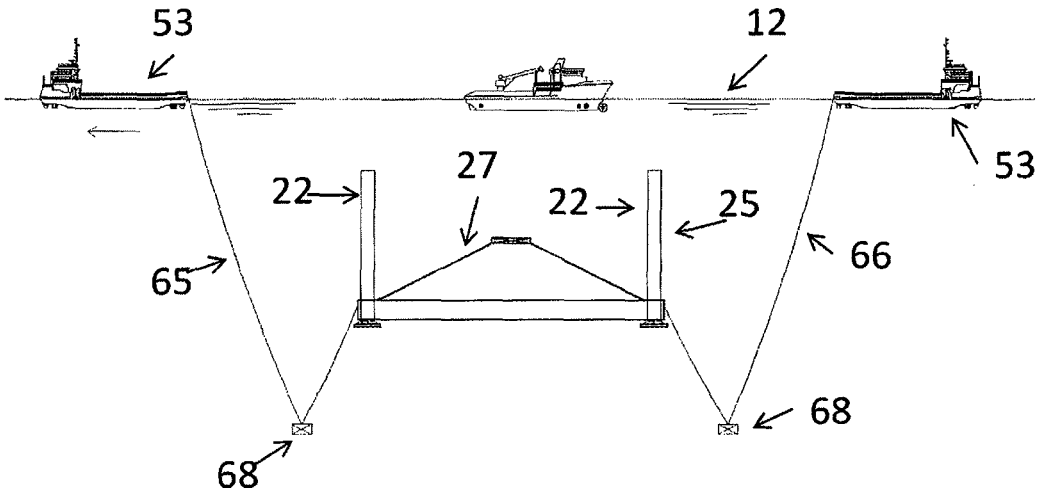
FIG. 2 is a view showing the towing to the site of the lower assembly of the recovery device in accordance with the invention.

Referring to FIG. 2, in a first step of the installation method the lower assembly (25) is then brought to the destination site and vertically above the underwater installation from which leaking hydrocarbons are escaping.

To this end, the lower assembly is connected to two tugs (53) via towlines (65, 66). The buoyancy of the recovery or lower assembly (25) is then adjusted (by partially filling the caissons of the canopy) to sink it a few meters below the surface of the sea. Weights (68) are also added to the cables in order for the towlines to be deployed under the lower or recovery assembly (25) and thereby contribute to stabilizing the position of the lower assembly (25) under the surface of the water.

The lower assembly (25) is then towed in the direction of the arrow to the destination site between the two tugs (53).

Once arrived at the destination site, in a second step of the installation method, the lower assembly (25) of the recovery system is ballasted so that it sinks progressively in the water. The towlines (65, 66) are paid out simultaneously to guide the lower assembly (25) toward the seabed. These lines (65, 66) are also used to control the descent of the lower assembly (25) toward the seabed.

Figure 3:
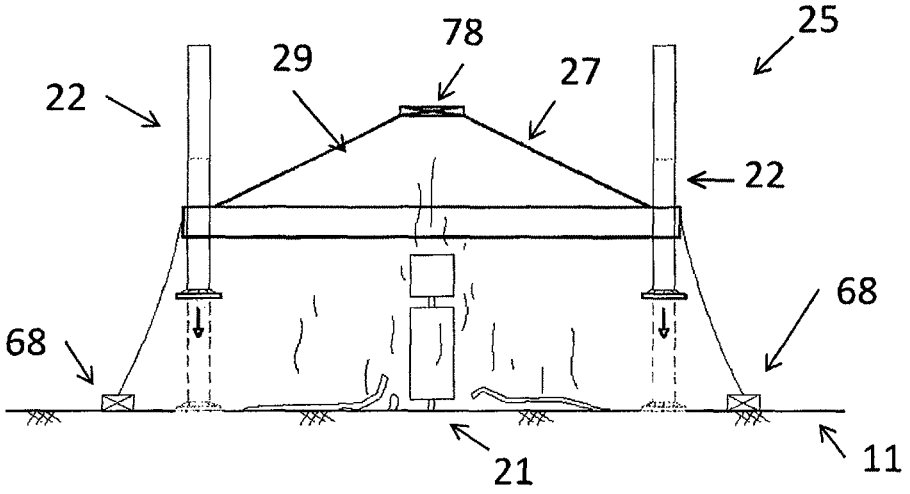
FIG. 3 is a view showing the final positioning of the lower assembly above the underwater installation.

On approaching the seabed (11), as shown in FIG. 3, the final positioning of the lower assembly is carried out by deploying the legs (22) toward the seabed (11) to anchor the rigid canopy (27) in a stable manner vertically over the underwater installation (21), here an oil well. This operation may be carried out with the assistance of underwater control systems.

Figure 4:
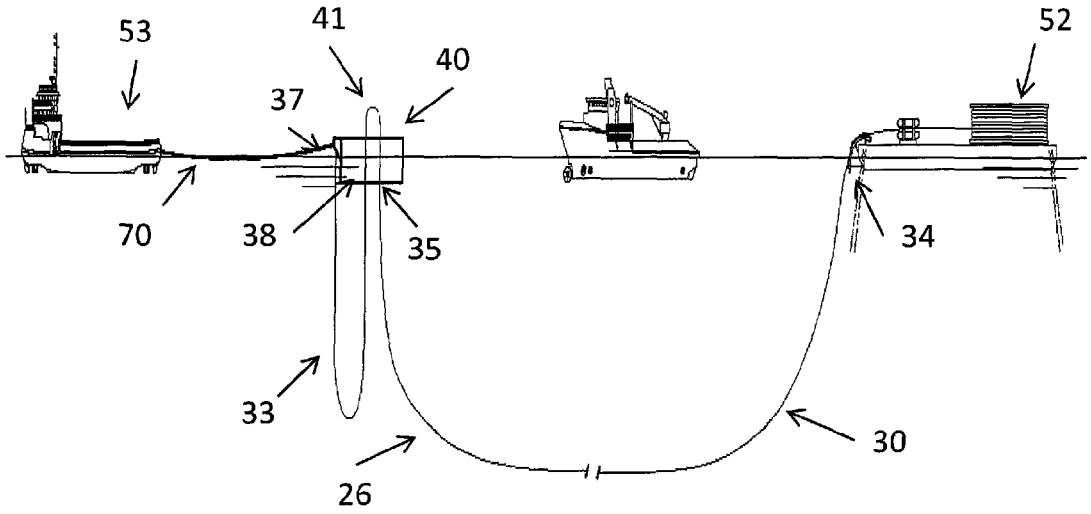
FIGS. 4 and 5 are views showing successive steps of assembling the upper assembly of the recovery device.
Figure 5:
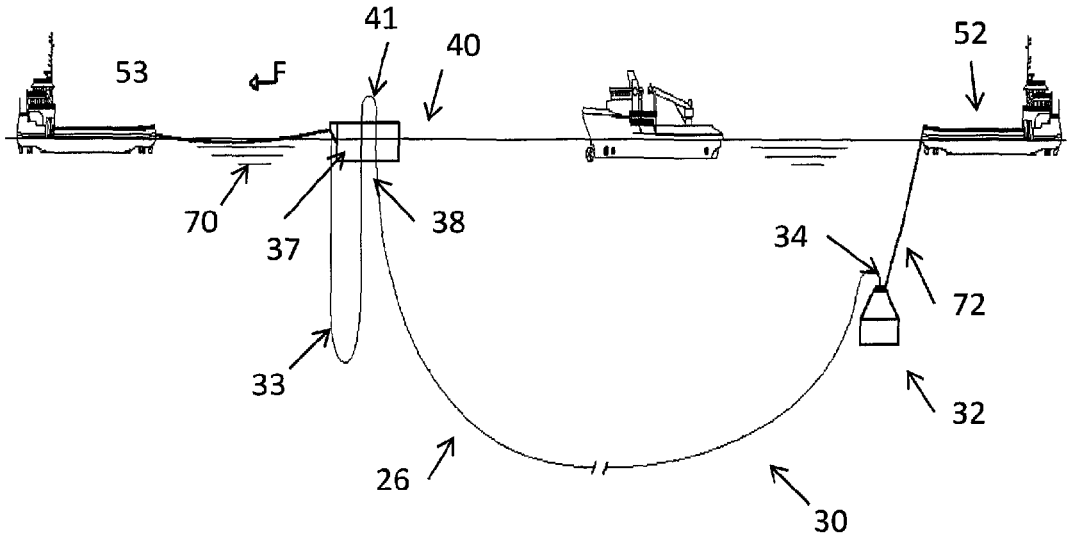
Figure 6:
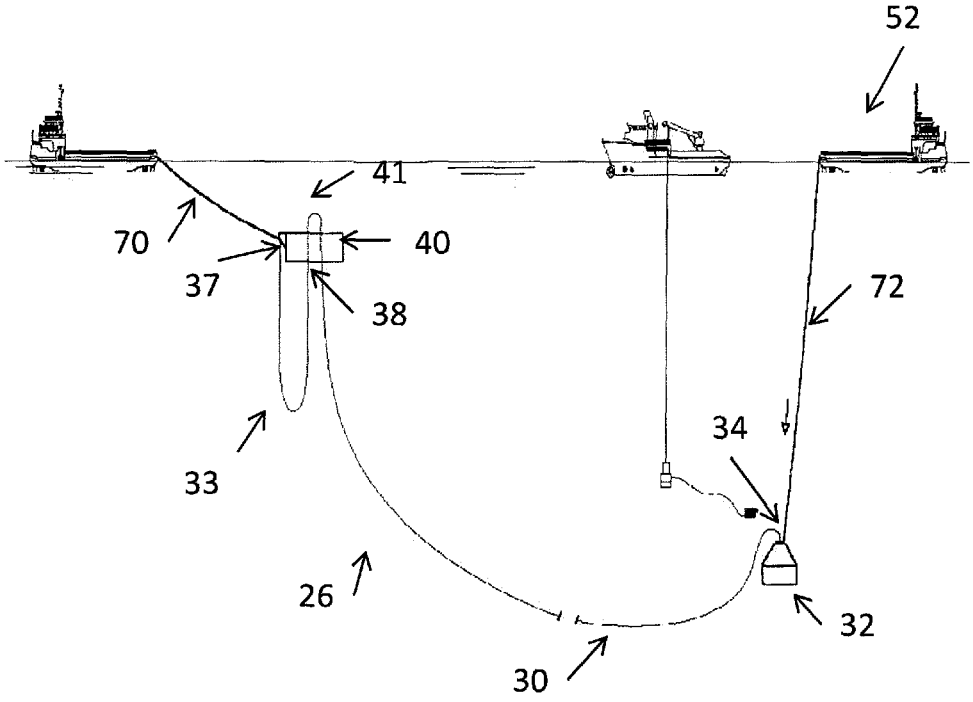
FIGS. 6 and 7 are views showing steps of connecting the upper assembly to the lower assembly of the hydrocarbon recovery device.

Referring to FIGS. 4 to 6, in a third step of the installation method the upper or hydrocarbon raising assembly (26) is assembled at sea, preferably at a location protected from ocean swell and waves, for example in a bay close to the onshore storage facility of the system. This assembly process includes a step of bringing a buoy (40) to the body of water. This buoy floats on the surface of the water essentially by virtue of its own resources. It is preferably of cylindrical and flat shape, which gives it better stability at sea. By a flat buoy is meant one in which the ratio of its height along the axis A-N to its diameter D is less than 1.5. A pipelaying ship (52) on which a flexible pipe is stored in a rack or on a storage reel is brought up to the vicinity of the buoy (40). The pipelaying ship also transports the collecting chamber (32) on deck.

A first flexible pipe (30) is paid out from this pipelaying ship (52). The downstream end (35) of the first flexible pipe is then connected to the buoy (40). The first flexible pipe (30) extends at this stage in a U-shape or double catenary shape between the buoy (40) and the pipelaying ship (52), which retains the upstream end (34) of the first flexible pipe (30). Alternatively, the upstream end (34) of the first flexible pipe is retained by a tug and the pipelaying ship (52) can be withdrawn.

A second flexible pipe (33) shorter than the first flexible pipe (30) is connected to the buoy; its upstream end (38) is connected to its final location in a space provided in the buoy and the downstream end (37) of the second flexible pipe is retained temporarily at the periphery of the buoy.

FIG. 4 shows the configuration of the upper or fluid raising assembly (26) once assembled and ready for towing during a fourth step of the method.

The buoy (40) advantageously has a height (H)/diameter (D) ratio less than 1.5. Accordingly, the first and second flexible pipes may be connected to the buoy after a pulling-in operation carried out from the upper surface of the buoy and the fluidic connection between the first and second flexible pipes may be established on top of the buoy using a rigid pipe connector (41).

A towline (70) connects the buoy (40) to a tug (53). The upper assembly (26) is towed in the direction of the arrow F by the tug 53 and the pipelaying ship (52) moves in the same direction at a speed matched to that of the tug.

This third step of assembling the upper assembly (26) is advantageously carried out in what is otherwise dead time, during the phase of installing the lower assembly (25), namely during step 1 and/or step 2 of the installation method described above. Accordingly, by carrying out a plurality of steps simultaneously, the time necessary to render the recovery assembly (10) operational is reduced.

When the upper assembly (26) nears the destination site, the collecting chamber (32) is connected to the upstream end (34) of the first flexible pipe (30). It is then connected to a cable (72) of a winch disposed on the ship (52), as shown in FIG. 5. The cable is progressively paid out. The collecting chamber (32), weighing about 100 to 150 tonnes, sinks toward the seabed under its own weight, in the direction of the arrow in FIG. 6.

Figure 7:
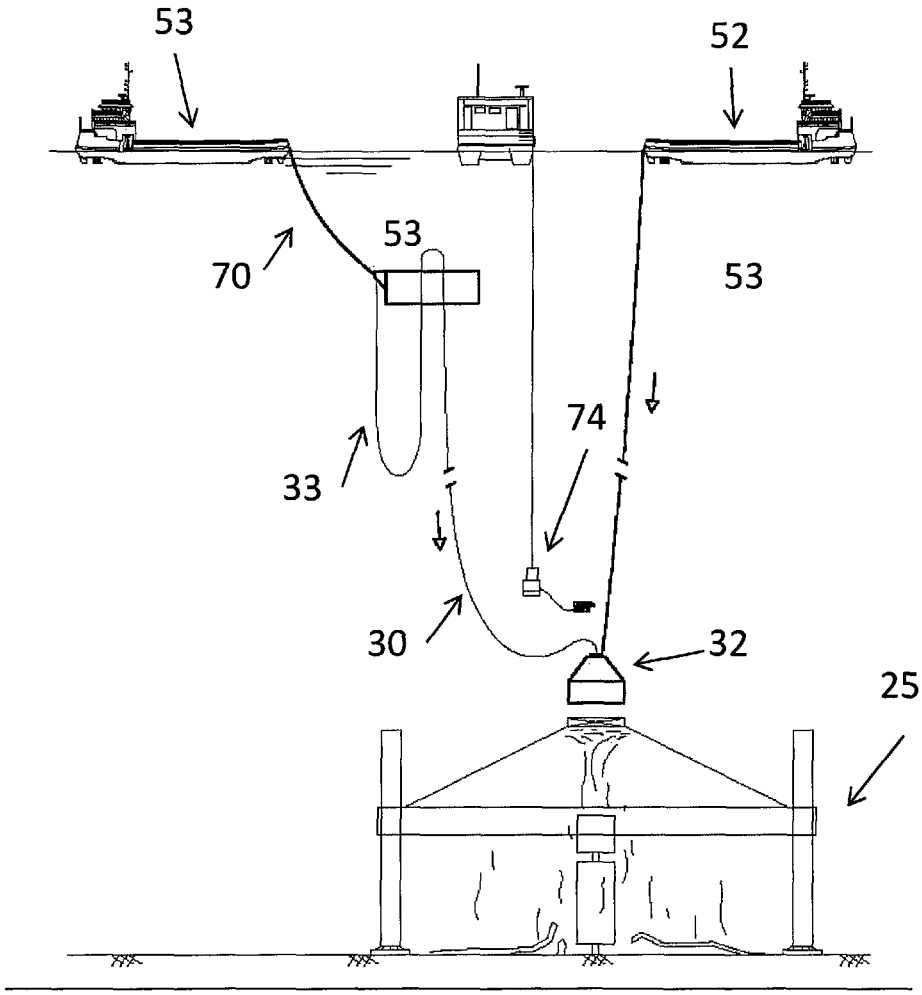

As shown in FIG. 7, during a fifth step of the method the collecting chamber is connected to the lower assembly that has already been installed vertically above the underwater installation. To this end the buoy is ballasted slightly more in order to guide the first flexible pipe (30) with the collecting chamber (32) toward the apex of the canopy (27). An unmanned submersible (74) is used to connect the collecting chamber to the canopy (27).

The upper assembly (26) is then connected to a surface installation (13).

Figure 8:
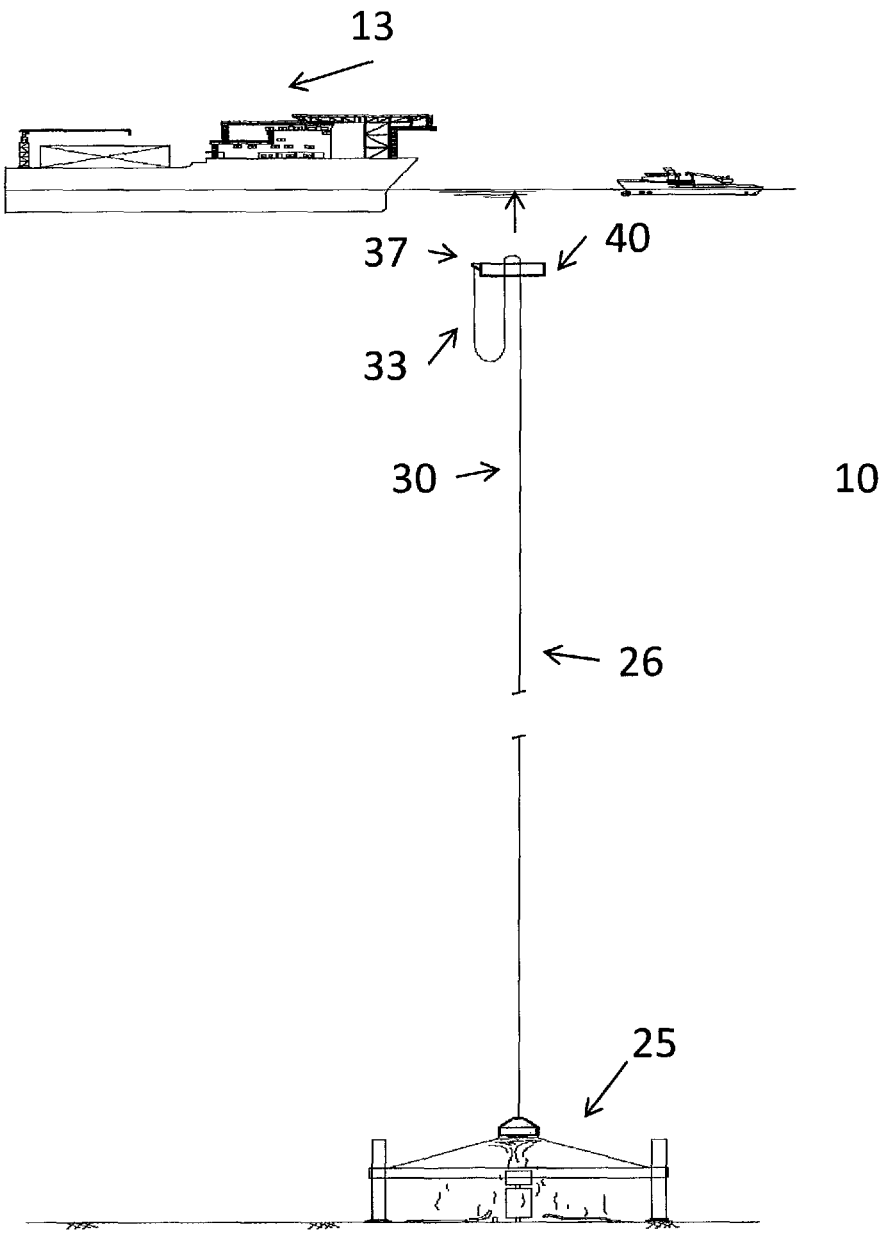
FIG. 8 is a view showing the connection of the recovery device to the surface installation.

To this end, and as shown in FIG. 8, in a sixth step of the installation method the first flexible pipe (30) is tensioned by increasing the buoyancy of the buoy (40), which therefore exerts the traction force necessary to maintain the first flexible pipe in a substantially vertical position.

Finally, the downstream end (37) of the second flexible pipe (33) is recovered and connected to the surface installation (13). It extends in the form of a catenary between the buoy and the ship (13).

The invention claimed is:

1. A method of installing an assembly for recovering hydrocarbons escaping from an underwater installation, the method comprising the steps of:

bringing to a destination site, where the underwater installation is located, a lower hydrocarbon raising assembly including a canopy and ballasting compartments;

deploying the lower assembly toward a seabed and vertically above the underwater installation;

assembling, while at sea, an upper fluid raising assembly configured and operable to raise hydrocarbon fluid between the seabed and a surface installation, the upper assembly including:

a first flexible pipe configured to extend substantially vertically between the seabed at the destination site and a surface of the sea;

a collecting chamber connected to an upstream end of the first flexible pipe;

a buoy connected to a downstream end of the first flexible pipe, the buoy being configured and adapted to be immersed below the surface of the sea at the destination site to maintain the first flexible pipe substantially in its vertical position; and a second flexible pipe extending in the form of a catenary and connected to the downstream end of the first flexible pipe and to the surface installation;

towing the upper assembly to the destination site;

connecting the collecting chamber to the lower assembly;

tensioning the first flexible pipe; and connecting a downstream end of the second flexible pipe to the surface installation, wherein the steps of assembling the upper assembly and towing the upper assembly to the destination site are performed in a first time period which is included in a second time period during which the step of bringing the lower assembly to the destination site is performed, or is included in a third time period during which the step of deploying the lower assembly toward the seabed is performed, or is included in a fourth time period during which the steps of bringing the lower assembly to the destination site and deploying the lower assembly toward the seabed are performed.

2. The installation method as claimed in claim 1, wherein the step of assembling the upper assembly comprises:

bringing the buoy to the sea;

paying out in catenary form the first flexible pipe from a pipelaying ship and connecting the downstream end of the first flexible pipe to the buoy while retaining the upstream end on the ship;

paying out the second flexible pipe and connecting an upstream end thereof to the buoy; and connecting the collecting chamber to the upstream end of the first flexible pipe.

3. The installation method as claimed in claim 2, further comprising: at the destination site, the steps of:

attaching a cable from the pipelaying ship to the collecting chamber, deploying the upstream end of the first flexible pipe together with the collecting chamber toward the seabed by paying out the cable, and then connecting the upstream end of the first flexible pipe with the collecting chamber to the canopy of the lower assembly.

4. The installation method as claimed in claim 1, further comprising the step of increasing the buoyancy of the buoy to maintain the first flexible pipe substantially in a vertical configuration by exerting a vertical traction force toward the surface of the sea.

5. The installation method as claimed in claim 1, further comprising the step of recovering the downstream end of the second flexible pipe before the step of connecting the downstream end of the second flexible pipe to the surface installation.

6. The installation method as claimed in claim 1, wherein the buoy has a height (H)/diameter (D) ratio less than 1.5, and further comprising the steps of:

connecting the first and second flexible pipes to the buoy after a pulling-in operation carried out from the upper surface of the buoy, and establishing a fluidic connection between the first and second flexible pipes on top of the buoy using a rigid pipe connector.

7. The installation method according to claim 1, wherein the canopy has the shape of an inverted funnel.

* * * * *